US005846340A

United States Patent [19]

Morin et al.

[11] Patent Number: 5,846,340

[45] Date of Patent: Dec. 8, 1998

[54] PROCESS FOR PREPARING A HEAT TREATMENT ATMOSPHERE AND METHOD FOR REGULATING SAID PROCESS

[75] Inventors: Jean-Claude Morin, La Chapelle Baton; Pascale Pourtalet McSweeney, Les Loges en Josas; Philippe Poynot, Gif sur Yvette, all of France

[73] Assignee: L'Air Liquide, Societe Anonyme Pour Procedex Georges Claude, Paris, France

[21] Appl. No.: 656,392

[22] Filed: May 31, 1996

[30] Foreign Application Priority Data

Apr. 23, 1996 [FR] France ..... 96 05105

[51] Int. Cl.[6] ..... C23C 8/20

[52] U.S. Cl. ..... 148/206; 148/231; 266/80; 266/257

[58] Field of Search ..... 148/206, 231; 266/252, 257, 80

[56] References Cited

U.S. PATENT DOCUMENTS

| | | | |
|---|---|---|---|
| 4,966,632 | 10/1990 | Ecalle et al. | 266/80 |
| 5,064,173 | 11/1991 | Ecalle et al. | 266/80 |
| 5,242,509 | 9/1993 | Rancon et al. | 148/206 |

FOREIGN PATENT DOCUMENTS

| | | |
|---|---|---|
| 482992 | 4/1992 | European Pat. Off. . |
| 2595801 | 9/1987 | France . |
| 2628752 | 9/1989 | France . |
| 2628753 | 9/1989 | France . |
| 93/21350 | 10/1993 | WIPO . |

OTHER PUBLICATIONS

Patent Abstracts of Japan, vol. 11, No. 176, JP62004439, Horoshi, Jan. 10, 1987.

*Primary Examiner*—Scott Kastler

*Attorney, Agent, or Firm*—Burns, Doane, Swecker & Mathis, L.L.P.

[57] ABSTRACT

Process for the preparation of a heat treatment atmosphere by a catalytic reaction in a catalytic reactor including an inlet and an outlet between a first gas mixture comprising oxygen and a second gas mixture comprising a hydrocarbon for the purpose of supplying said atmosphere to a user site comprising at least one user location, comprising the steps of:

a) feeding said first and second gas mixture at a given flowrate into the inlet of said catalytic reactor;

b) continuously measuring the pressure of the heat treatment atmosphere obtained at the reactor outlet;

c) comparing the pressure measured during step b) with a setpoint pressure level $P_c$ to obtain a comparison result; and d) according to the comparison result obtained during step c), exercising feedback as necessary on the respective flow rates of the first gas mixture and/or second gas mixture arriving at the inlet of the catalytic reactor, so as if necessary to return the pressure of the heat treatment atmosphere at the reactor outlet to the setpoint level $P_c$.

13 Claims, 2 Drawing Sheets

PROCESS FOR PREPARING A HEAT TREATMENT ATMOSPHERE AND METHOD FOR REGULATING SAID PROCESS

BACKGROUND OF THE INVENTION (i) Field of the Invention

The present invention relates to the field of heat treatment atmospheres. More particularly, the present invention relates to the atmospheres produced by the reaction, in a catalytic gas deoxygenation reactor, between a first mixture containing oxygen and a second mixture containing a hydrocarbon.

The "first mixture" is generally composed of a mixture of air and cryogenic nitrogen, or an impure nitrogen containing a residual concentration of oxygen as produced on site by separation of air by permeation or adsorption.

The "second mixture", for its part, most commonly consists of natural gas or propane, or a mixture of hydrocarbons.

(ii) Description of the Related Art

In practice, the control of the operation of these generators is considered very difficult when the site has variable requirements for the atmosphere flow rate. This problem can arise both in a case (a) where the generator supplies several furnaces in a plant, and in a case (b) where it supplies a single furnace:

case a): in the case of supply of a multi-furnace site, one (or more) of the furnaces are commonly stopped at any one time during the production day or production week. Such a stoppage can be carried out by conventional means, manually by means of a valve located on the line supplying the furnace, or, for example, at the level of the atmosphere generator itself, which will then automatically control the closure of a solenoid valve on the line involved.

Then, by whatever means, the atmosphere generator will be signaled to give a lower output (subtraction of the consumption by the furnace that will be stopped), and the generator will therefore be made to deliver a reduced total output.

The output produced will thus be decreased while the pressure at the outlet of the catalytic reactor will be altered, with the closure of a furnace increasing the pressure drop at the reactor outlet.

In effect, it is necessary to consider the fact that each line possesses its own pressure drop (due to the length of the line or to the presence of devices such as valves or flowmeters in the line, etc.), and thus the output from the generator newly regulated in adaptation to the number of furnaces remaining in service will be more or less distributed among the open lines in accordance with the pressure drop in each line. Thus, in practice it is not possible to be certain of the distribution of the output among the individual lines, that is, at the level of each furnace, and it is therefore common for the operator to have to manually readjust the flow to each furnace in order to bring it to the flow level effectively required by the furnace involved.

case b): to illustrate the case in which the gas flow requirements can vary for a single furnace fed by the generator, one can cite the case of a bell furnace.

These bell furnaces employ temperature profiles of a few hours or even a few tens of hours, typically including a more or less regular rise in temperature, a temperature plateau, and a cooling phase. During the thermal plateau, the user usually employs a decreasing flow rate, generally decreasing in steps.

In addition the user ordinarily maintains some overpressure (typically on the order of a few tens of millibars) in the bell furnace, with the goal of limiting the entry of air into the bell. Under these particular conditions of flow rate variation, the maintenance of this overpressure under all circumstances is considered to be particularly difficult and usually is accomplished manually in—actuality through the intervention of a valve.

One object of the present invention is then to propose an improved process for the generation of an atmosphere of the previously defined type, which makes it possible to precisely control the quantity of atmosphere injected into each furnace, for example, regardless of how many furnaces are in service at the user site.

The process according to the present invention for preparing a heat treatment atmosphere by a catalytic reaction in a catalytic reactor between a first gas mixture containing oxygen and a second gas mixture containing a hydrocarbon, for the purpose of supplying the atmosphere to a user site comprising at least one heat treatment furnace, then comprises the following steps:

a) the pressure of the heat treatment atmosphere obtained at the outlet of the catalytic reactor is continuously measured;

b) the pressure measurement performed during step a) is compared with a setpoint pressure $P_c$; and c) according to the result of the comparison performed in step b), feedback is exercised as necessary on the respective flow rates of the first gas mixture and/or second gas mixture arriving at the inlet to the catalytic reactor, in order thereby to bring the pressure of the resulting heat treatment atmosphere at the reactor outlet to the level of the setpoint $P_c$.

Studies by the applicant have in effect demonstrated that the management of a pressure setpoint at the outlet of the catalytic reactor provides a solution to the problems posed by both multi-furnace installations and installations where a single heat treatment furnace is to be supplied.

An installation having three continuous heat treatment furnaces will be illustrated as an example. At a given time, the user stops furnace no. 3. This intervention causes the pressure at the outlet of the catalytic reactor to rise because of the pressure drop introduced by the closure of supply line no. 3.

SUMMARY AND OBJECTS OF THE INVENTION

According to the invention, the flows of the first and second gas mixtures supplying the catalytic reactor are adjusted so as to obtain at the outlet a heat treatment atmosphere whose pressure is brought to the setpoint level $P_c$.

Since the pressure is reestablished at the setpoint pressure level and the pressure drop is, as already indicated, fixed in each line, such an operation fixes the flow rate delivered into each service line of the installation at the flow rate level which each furnace ordinarily requires (thus without any perturbation of its operation).

The pressure setpoint $P_c$ at the reactor outlet is set on a case-by-case basis for each user site as a function of the maximum flow rate which the site under consideration requires and the pressure drop which characterizes the network.

The setpoint $P_c$ is usually located in the interval [50 mbar, 400 mbar] relative.

This case of parallel supply to a three-furnace user site will be considered in greater detail below in the context of examples.

The first gas mixture according to the invention could, for example, consist of an impure nitrogen containing some residual concentration of oxygen, as obtained by the separation of air by permeation or adsorption, or as could be obtained by mixing air and cryogenically generated nitrogen.

DETAILED DESCRIPTION OF PREFERRED EMBODIMENTS

Figure 1:
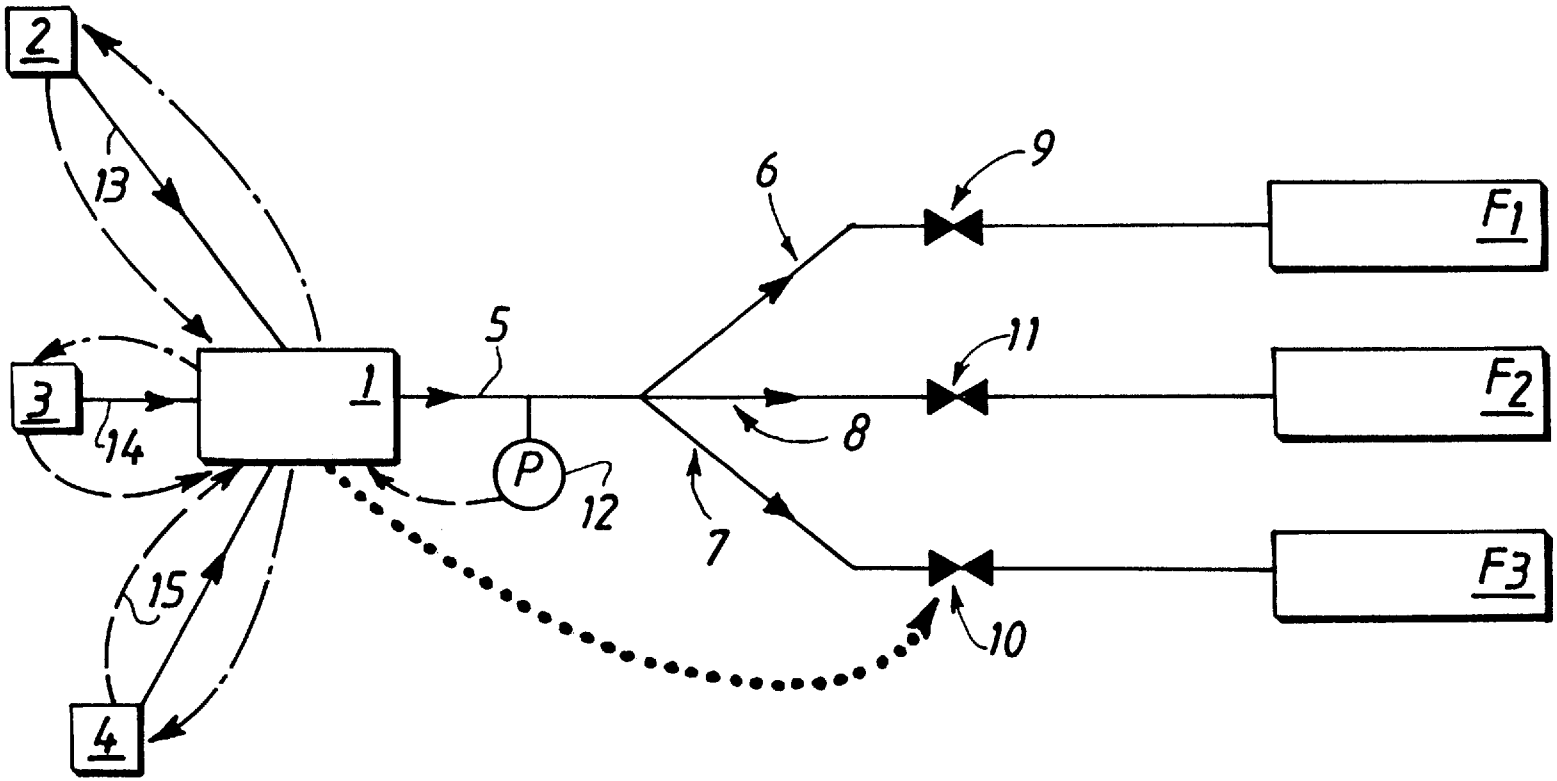
FIG. 1 is a schematic representation of an installation appropriate for implementation of the atmosphere-generating process according to the present invention.

Still for illustration, the hydrocarbon-containing second gas mixture could consist of natural gas or a mixture of hydrocarbons, but it could also be a more complex mixture consisting of an industrial by-product from an industrial site where a process leads to the production of such a by-product, and which then preferably contains a high proportion (typically at least 50% of the total mixture) of the mixture consisting of hydrogen, a hydrocarbon, and Co.

The catalytic reactor according to the invention can, for example, include a catalyst based on a nonnoble metal such as nickel or copper, or based on a precious metal such as platinum or palladium.

According to one embodiment of the invention, the catalytic reactor used employs a catalyst based on a precious metal such as palladium or platinum, with the reaction between the first gas mixture and the second gas mixture being carried out in the interior of the reactor in a temperature range from 400° C. to 900° C.

According to another embodiment of the invention, the catalytic reactor used employs a catalyst based on nonprecious metal, such as nickel, with the reaction between the first gas mixture and the second gas mixture being carried out in the interior of the reactor at a temperature between 800° C. and 1200° C.

The means used to monitor the pressure measured at the reactor outlet, make the comparison between the pressure measured at the reactor outlet and the setpoint pressure $P_c$, and effect feedback on the flows entering the reactor in order to maintain the pressure level $P_c$ can include any type of data processing unit—including means for controlling the operation of control means such as, for example, flow control means (valves, solenoid valves, etc.) —wherein the unit in particular receives pressure data measured at the outlet of the catalytic reactor.

Various modes of implementation of these control means can be considered, such as, for example, a PID controller or any other controller known from art.

Given that the previously mentioned operations of monitoring, comparison, and feedback can manifest themselves, for example, in a programmed form in the data processing unit, the latter then comprises any appropriate programmable computer known from the art.

For illustration, the unit could, for example, comprise a programmable automatic controller.

The notion of "continuous" control of the pressure at the outlet of the reactor should be understood as related to the acquisition rate of the means used; for the example of a programmable automatic controller, data refresh generally takes place every fraction of a second.

According to one aspect of the invention, the heating temperature of the catalytic reactor is slaved to the flow rate of the atmosphere to be produced. For example, it is possible to effect such slaving by defining a certain number of ranges for the atmosphere flow rate that the reactor needs to produce in order to supply the user site according to all its operating variants, and associating with each range a setpoint for the heating temperature of the catalytic reactor.

The process according to the invention can prepare heat treatment atmospheres with quite varied compositions specifically in response to the needs of the user site under consideration and the starting residual oxygen concentration of the nitrogen-based first gas mixture, to which are added in particular hydrogen (preferably 1 to 30 volume %), CO (preferably 0.5 to 15 volume %), $CO_2$ (preferably 100 volume-ppm to 2 volume %), and water vapor (for a dew point preferably between −40° C. and +20° C., or even +30° C.) in adaptation to the intended types of heat treatment needing a protective atmosphere or a more active atmosphere, for example, a decarburizing atmosphere.

In order to ensure the substantial absence of oxygen in the resulting atmosphere, it is preferable to operate with a slightly superstoichiometric amount of hydrocarbon in order to leave residual hydrocarbon remaining in the resulting atmosphere.

We will not detail here the calculations that are commonly carried out by the individual skilled in the art based on the stoichiometry of the reactions occurring between oxygen and the hydrocarbon and the given characteristics of the atmosphere to be prepared (flow rate and composition, for example, of CO and $H_2$) for the purpose of determining the minimum residual oxygen concentration necessary in the source of the first gas mixture, the flow rate of this first gas mixture to be employed, and the flow rate of the hydrocarbon-containing second gas mixture that will achieve at least stoichiometric conditions and possibly even slightly superstoichiometric conditions.

A pressure level P of the atmosphere at the reactor outlet is registered and transmitted to the data processing unit, and this unit compares P with the setpoint $P_c$ and regulates the pressure so that P is returned to the level of the setpoint value $P_c$.

This regulation is accomplished by adjusting the total flow rate of the produced atmosphere, with the difference between P and $P_c$ thus being translated into a setpoint for the total flow rate of the atmosphere, which then becomes a matter of the flow rate/concentration calculations alluded to above.

For illustration, the regulation can be carried out, for example, as follows using a programmable automatic controller:

- the automatic controller receives a pressure measurement P which is registered at the outlet of the catalytic reactor;
- the automatic controller converts this measurement to digital form (ranging from 0 to $N_{max}$);
- this digital form N is sent to a PID control block which performs a control and transmits at its output a value N' representing the result of the control (the controller operates, for example, by inverted output: the higher the pressure is, the lower the numerical value tends to be);
- the automatic controller then converts the pressure difference $P-P_c$ into a flow rate setpoint $Q_c$ using the rule of three:

| PID output --------→ flow rate in $Nm^3/h$ | |
|---|---|
| 0 | 0 |
| $N_{max}$ | $Q_{max}$ |
| N' | $Q_c$ |

with $Q_c=(Q_{max}\times N')/N_{max}$ where $Q_{max}$ is equal to the maximum flow rate value that the installation can produce (i.e., the full-scale flow rate); and the automatic controller then translates this setpoint for the overall flow rate $Q_c$ into setpoints for the flow rates $Q_{N2\text{-}O2}$ of the oxygen-containing first gas mixture and $Q_{CxHy}$ of the hydrocarbon-containing second gas mixture.

Whatever the method used, it will be advantageous to proceed, starting from a flow rate setpoint $Q_c$ and from the required composition of the atmosphere, according to the following chronology:

calculation of the flow rate setpoint $Q_{N2\text{-}O2}$ of the oxygen-containing first gas mixture; and calculation, from $Q_{N2\text{-}O2}$, of the flow rate setpoint $Q_{CxHy}$ of the hydrocarbon-containing second gas mixture (preferably applying a slight superstoichiometry with respect to the setpoint $Q_{N2\text{-}O2}$).

It will be noted that this chronology offers the advantage of calculating the setpoint for the hydrocarbon flow rate from the actual flow rate of the first gas mixture (for example, impure nitrogen) and not from the setpoint for the total flow rate of the atmosphere. This substantially avoids the risk of soot formation (calculating at the outset of the control the setpoint for the hydrocarbon flow rate from the setpoint for the total flow rate of the atmosphere leads to a risk of employing an uncontrolled excess of hydrocarbon with respect to oxygen and thus to possible soot formation).

The invention also relates to a method for the regulation of a process for the preparation of a heat treatment atmosphere, in the course of which a first gas mixture gas mixture containing oxygen and a second gas mixture containing a hydrocarbon are reacted in a catalytic reactor for gas deoxygenation in order to obtain at the reactor outlet a desired heat treatment atmosphere for the purpose of supplying a user site comprising at least one user furnace, according to which:

a) the pressure of the heat treatment atmosphere obtained at the outlet of the catalytic reactor is continuously measured;

b) the pressure measurement obtained in step a) is compared with an established setpoint pressure $P_c$; and c) according to the result of the comparison carried out during step b), feedback is exercised as necessary on the respective flow rates of the first gas mixture and/or second gas mixture arriving at the catalytic reactor in order thereby to reestablish the pressure of the heat treatment atmosphere at the reactor outlet at the setpoint level $P_c$.

The invention also relates to an installation for the preparation of a heat treatment atmosphere, wherein said installation comprises:

a source of an oxygen-containing first gas mixture;

a source of a hydrocarbon-containing second gas mixture; and a catalytic reactor for deoxygenation of a gas, suitable for producing at its outlet the said heat treatment atmosphere as the result of reaction within the reactor between the first gas mixture and the second gas mixture, the said installation characteristically comprising:

a) a first means that continuously measures the pressure of the atmosphere at the reactor outlet;

b) a second means that monitors the measurement made by the first means and compares the result of that measurement with a setpoint pressure $P_c$; and c) a third means that, according to the result of the comparison carried out during step b), as necessary adjusts the respective flow rates of the first gas mixture and/or second gas mixture arriving at the catalytic reactor in order to return the pressure to the setpoint pressure level $P_c$.

According to one embodiment of the invention, the second and third means are combined in a data processing unit comprising a programmable computer and means for controlling the operation of a flow control means.

According to one embodiment of the invention, the control means comprises a PID controller.

Figure 2:
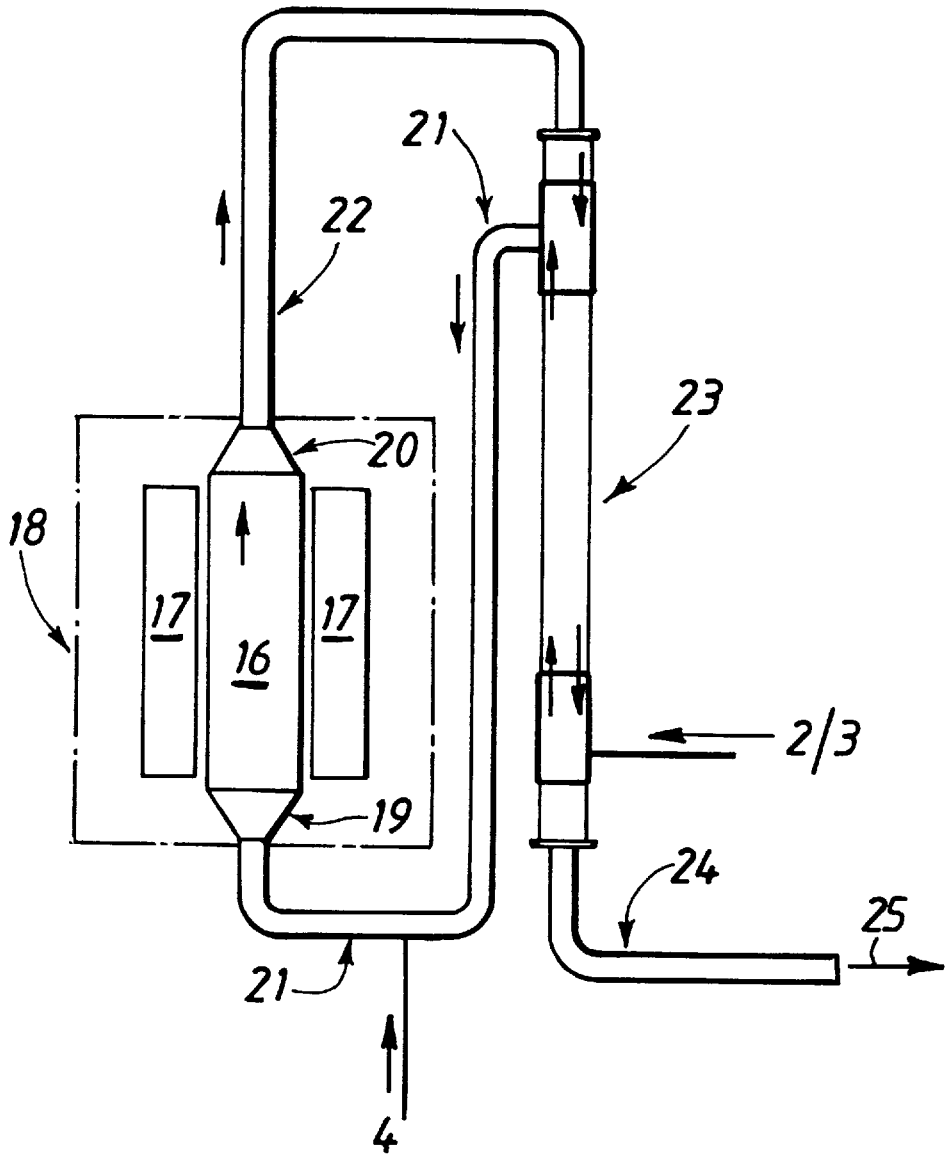
FIG. 2 is a more detailed schematic representation of the catalytic generator 1 of FIG. 1.

Other characteristics and advantages of the present invention will become evident from the following description of embodiments provided by way of illustration but in no way restrictive, given in connection with the appended drawings in which:

FIG. 1 is a schematic representation of an installation appropriate for implementation of the atmosphere-generating process according to the present invention; and FIG. 2 is a more detailed schematic representation of the catalytic generator 1 of FIG. 1.

The box labeled 1 in the figure schematically represents the atmosphere generator, comprising here, as detailed below with reference to FIG. 2, a catalytic reactor based on alumina-supported platinum, a gas/gas exchanger, as well as a data processing unit comprising a programmable automatic controller.

The reactor is supplied with an oxygen-containing first gas mixture, obtained here as a mixture between air (source 2) and cryogenically obtained nitrogen (source 3), and a hydrocarbon-containing second gas mixture consisting in this case of natural gas (source 4).

The first gas mixture according to the invention could also consist, for example, of an impure nitrogen obtained by permeation or adsorption.

The heat treatment atmosphere resulting from the reaction of these mixtures in the interior of the reactor is delivered, via gas line 5, into a number of parallel gas lines (6, 7, 8), thereby supplying at the ends of the lines three heat treatment furnaces denoted in the figure as F1, F2, and F3.

Each of the lines is equipped with a means for creating a pressure drop in the line (respectively 9, 10, and 11), which can consist, for example, of the following means: a throttle valve, or a stop valve that the user uses to throttle the flow arriving in the line, or a gas switching panel. But more generally, this means for creating a pressure drop can also be obtained by the configuration of piping used in each line, or by the configuration of nozzles for injection of the atmosphere into each furnace.

A means (12) for measurement of the pressure of the atmosphere pressure data originating from the pressure detector 12), mixed dot-dash lines ( - . - . - . - ) symbolize examples of feedback from the unit to the gas sources supplying the catalytic reactor, and the pure dotted line ( . . . ) symbolizes one example of the action of the unit on one of the lines of the network, to close this line, for example, as a result of a voluntary action by the user at the level of the generator 1 (for example, by the action on a push button).

The configuration represented in the context of this figure is merely illustrative of the numerous possibilities for data flows and actions transmitted to and coming from the data processing unit; still for illustrative purposes, it is possible to cite the following cases:

i) data flows to the unit:

the temperature measured in the interior of the reactor (this permits, for example, the specification of a threshold that when crossed results in the injection of the reaction mixture or of a safety threshold that when crossed results in shutdown of the installation);

the pressure measured at the inlet of the catalytic reactor;

the pressure measured in the system carrying the first gas mixture (for example, on the impure nitrogen system);

the pressure measured in the cryogenic nitrogen system when such a source is employed; and various and sundry data coming from the furnaces (temperature, composition of the atmosphere in the interior of the furnace, . . . ).

ii) flows of actions from the unit:

adjustment of the heating temperature for the resistances surrounding the reactor (according to one of the aspects of the invention, this temperature could be slaved to the flow rate of the atmosphere produced); and feedbacks associated with installation safety (overheating, deficiency in one or another of the fluids requiring, for example, switching to another source, . . . ).

In FIG. 2, which provides a schematic partial illustration of one embodiment of the catalytic generator 1, the oxygen-containing gas mixture ⅔, after having passed into one of the paths of a plate exchanger 23, is directed via a conduit system 21 to the low point 19 of a catalytic reactor 16. The hydrocarbon-containing second gas mixture 4 is added to this first gas mixture prior to the arrival of the first gas mixture in the catalytic reactor.

The heat treatment atmosphere resulting from the reaction between the two mixtures in the interior of the reactor 16 is discharged, via the high point 20 of the catalytic reactor, through a gas line 22 that is connected to another path of the exchanger 23, from which it reemerges through a conduit 24 to be directed to one or more user locations 25, F1, F2, . . . .

Reference number 17 denotes the heating resistances surrounding the catalytic reactor, and the rectangle 18 denotes thermal insulation surrounding the reactor.

Out of concern for ease of reading the figure, this FIG. 2 does not include details of the data processing unit or the systems for pressure measurement and flow rate control means from which the unit (for example, the automatic controller) gathers data or on which it exerts actions.

We claim:

1. Process for the preparation of a heat treatment atmosphere by a catalytic reaction in a catalytic reactor including an inlet and an outlet between a first gas mixture comprising oxygen and a second gas mixture comprising a hydrocarbon for the purpose of supplying said atmosphere to a user site comprising at least one user location, comprising the steps of:

a) feeding said first and second gas mixture at a given flowrate into the inlet of said catalytic reactor and obtaining the heat treatment atmosphere;

b) continuously measuring the pressure of the heat treatment atmosphere obtained at the reactor outlet;

c) comparing the pressure measured during step b) with a setpoint pressure level $P_c$ to obtain a comparison result; and d) according to the comparison result obtained during step c), exercising feedback as necessary on the respective flow rates of at least one of the first gas mixture and the second gas mixture arriving at the inlet of the catalytic reactor, so as if necessary to return the pressure of the heat treatment atmosphere at the reactor outlet to the setpoint level $P_c$.

2. Process according to claim 1, wherein a precious metal-based catalyst is employed in the reactor and the reaction is carried out at a temperature between 400° C. and 900° C.

3. Process according to claim 1, wherein a catalyst based on nonprecious metal is used in the reactor and the reaction is carried out at a temperature between 800° C. and 1200° C.

4. Process according to claim 2 or 3, wherein the reactor heating temperature is determined by the flow rate of the produced atmosphere.

5. Process according to claim 1, wherein said first gas mixture is an impure nitrogen produced by separation of air by a membrane process or by adsorption, having a residual oxygen concentration greater than or equal to 0.5%.

6. Process according to claim 5, wherein the residual oxygen concentration is between 2 and 7%.

7. Process according to claim 1, wherein said first gas mixture is a mixture of air and cryogenically obtained nitrogen.

8. Process according to claim 1, further comprising carrying out a heat exchange between (i):

said heat treatment atmosphere between its exit from the catalytic reactor and its arrival at a user location; and (ii) said oxygen-containing first gas mixture, prior to its entry into the catalytic reactor.

9. Method for regulation of a process for preparing a heat treatment atmosphere, in the course of which process an oxygen-containing first gas mixture and a hydrocarbon-containing second gas mixture are reacted in a catalytic reactor including an inlet and an outlet in order to obtain said heat treatment atmosphere at the reactor outlet for the purpose of supplying said atmosphere to a user site comprising at least one user location, comprising the steps of:

a) feeding said first and second gas mixture at a given flowrate into the inlet of said catalytic reactor;

b) continuously measuring the pressure P of said heat treatment atmosphere obtained at the outlet of the catalytic reactor;

c) comparing the pressure P measured during step b) with a setpoint pressure level $P_c$ to obtain a comparison result; and d) according to the comparison result obtained during step c, exercising feedback as necessary on the respective flow rates of at least one of the first gas mixture and the second gas mixture arriving at the catalytic reactor inlet so as to return, if necessary, the pressure P to the level of the setpoint pressure $P_c$.

10. Method of regulation according to claim 9, comprising returning the pressure P to the level of the setpoint value $P_c$ by adjusting the total flow rate of the produced heat treatment atmosphere, with the difference between P and $P_c$ being translated into a total flow rate setpoint $Q_c$ for the total flow rate of the atmosphere, and, using the data for the total flow rate setpoint $Q_c$ and the composition of the required atmosphere, carrying out the following steps:

calculating a setpoint $Q_{N2\text{-}02}$ for the flow rate of the oxygen-containing first gas mixture; and calculating, based on the setpoint $Q_{N2\text{-}02}$, a setpoint $Q_{CxHy}$ for the flow rate of the hydrocarbon-containing second gas mixture.

11. Installation for preparation of a heat treatment atmosphere comprising:

a source of a first gas mixture comprising oxygen;

a source of a second gas mixture comprising a hydrocarbon; and a catalytic reactor including an interior an inlet and an outlet for deoxygenation of a gas, suitable for producing at its outlet said heat treatment atmosphere at a given pressure from a reaction in the interior of the reactor between the first gas mixture and the second gas mixture, comprising:

a) a first means for continuously measuring the pressure of the atmosphere at the reactor outlet;

b) a second means for comparing the pressure measured during step a) with a setpoint pressure level $P_c$; and c) a third means, based on the comparing carried out during step b), for adjusting as necessary respective flow rates of the first gas mixture and/or second gas mixture arriving at the catalytic reactor in order to return said pressure to the level of the setpoint pressure $P_c$.

12. Installation according to claim 11, wherein the second and third means are combined into a data processing unit comprising a programmable computer and means for controlling the flowrates of the first and second gas mixtures.

13. Installation according to claim 11 or 12 comprising a programmable automatic controller.

* * * * *